US006220597B1

(12) United States Patent
Scibetta

(10) Patent No.: US 6,220,597 B1
(45) Date of Patent: Apr. 24, 2001

(54) 52 CARD POT GAME OF CHANCE

(76) Inventor: Joseph Scibetta, 6 Ferncliff Rd., Jersey City, NJ (US) 07305

( * ) Notice: Subject to any disclaimer, the term of this patent is extended or adjusted under 35 U.S.C. 154(b) by 0 days.

(21) Appl. No.: 09/507,657

(22) Filed: Feb. 22, 2000

(51) Int. Cl.[7] ..... A63F 1/00
(52) U.S. Cl. ..... 273/292; 273/274; 273/309
(58) Field of Search ..... 273/292, 274, 273/309

(56) References Cited

U.S. PATENT DOCUMENTS

| | | | | |
|---|---|---|---|---|
| 5,395,120 | | 3/1995 | Malek | 273/292 |
| 5,407,208 | * | 4/1995 | Keller et al. | 273/274 |
| 5,407,209 | * | 4/1995 | Prerost | 273/292 |
| 5,413,353 | * | 5/1995 | Demarest et al. | 273/292 |
| 5,486,005 | | 1/1996 | Neal | 273/292 |
| 5,489,101 | | 2/1996 | Moody | 273/292 |
| 5,529,309 | * | 6/1996 | Barlett | 273/292 |
| 5,607,162 | * | 3/1997 | Boylan | 273/292 |
| 5,649,705 | * | 7/1997 | String | 273/292 |
| 5,690,337 | | 11/1997 | Somma et al. | 273/309 |
| 5,707,285 | * | 1/1998 | Place et al. | 463/13 |
| 5,839,731 | | 11/1998 | Feola | 273/292 |
| 5,845,906 | | 12/1998 | Wirth | 273/274 |
| 6,019,374 | * | 2/2000 | Breeding | 273/292 |

* cited by examiner

*Primary Examiner*—Steven Wong
*Assistant Examiner*—Delores R. Collins
(74) *Attorney, Agent, or Firm*—Dilworth & Barrese

(57) ABSTRACT

A novel game and board or surface is played in combination by at least two players, one being a player and bettor and the other being a dealer or croupier using at least one standard deck of 52 cards. Also used by the croupier are a shuffling machine for cards, a dealing machine for cards and a catch bin for discarded or played cards. The order of play and payoffs for each bet are set by the house or the croupier. The novel game is played by a player first placing a bet in a betting spot using chips, for example. Next, the dealer deals six cards to each player face down onto an area on the table called a pot and designated for that player and afterwards deals six cards to another area on the table called a dealer's pot in a location on the table designated for the dealer's pot. One play in a series of six comprises the dealer turning up a player's top card and turning up the dealer's top card: High wins at even odds of 1 to 1; equal cards are a draw or push and neither wins except if a player has a deuce, the player's deuce is an automatic loss, the player loses; a player's ace wins at odds of 3 to 2. After one play, a player may place a new bet before cards are next turned over. Overturned cards are discarded into a catcher or bin located on the table for discarded or played cards. More than one deck can be used and multiple players can play the game.

5 Claims, 1 Drawing Sheet

52 CARD POT GAME OF CHANCE

BACKGROUND

1. Field of the Invention

The present invention relates to casino games, and more particularly, but not by way of limitation, to a wagering game employing a standard deck of 52 cards, shuffled and then played and dealt in a specific sequence in combination with participating players betting against a dealer or the house that the participating player has a higher card winning hand. It is related to card games that can also be played in non-gambling settings.

2. Description of the Prior Art

Games of chance employing a deck of 52 cards are as old as the invention of cards themselves. The concept of using high cards in which to play and wager in card games is also old. Even so, the prior art discloses many novel patented card gaming tables and many novel patented card games to be played on them.

Card games generally employ one or more cards which, when dealt upon a horizontal surface, determine a score based upon indicia displayed by the upwardly facing sides or faces of the resting cards when the cards are turned face up.

Feola in U.S. Pat. No. 5,839,731 which issued on Nov. 24, 1998 describes a novel casino game based on a selected card game in which a player wagers on one or more of a group of dealt hands, i.e. a random grouping, pile, or pot of cards, and where the chances of winning are not enhanced by the skills of the player and no discretion in the selection of cards is vested in either the player or dealer. A relatively complex card game, such as blackjack, baccarat, or stud poker, is selected. A number of hands are dealt as lines or arrays on a playing surface and players wager as to which hand will win. The playing surface has a dealer position including a line or array for each hand dealt to the dealer. Player positions are located in a semicircle around the dealer position, each including a location at which wagers are placed. Winning wagers are paid a multiple of the wager. Optionally, the multiple is based on the odds of obtaining the particular winning combination.

In Somma et al. in U.S. Pat. No. 5,690,337 which issued Nov. 25, 1997 a relatively complex casino card game is disclosed. Utilized is a single, 41-card deck of playing cards consisting of a standard, 4-suit playing card deck from which all "face" cards have been removed and a single "joker" card has been added. Play of the game starts with a first player selecting a card value, termed the "dealer number". No bets can be placed on the dealer number. Players may then place their wager(s) on any of the remaining "live" numbers, and the dealer deals a first playing card, face up. If the identified "dealer number" card value is turned over, all players having placed a bet on any of the "live" numbers win, and are paid off even money. If the card has a value other than the "dealer number", the house wins all bets placed on the "value" number of the card that was turned over, and that value number is thereafter considered "dead". Play continues, with the players given an opportunity to place additional bets on the remaining, "live" card values prior to turning over the next card. If the "joker" card is dealt by the dealer at any time before the "dealer number" has been dealt, the house wins all remaining bets, and the game is over.

Earlier in Boylan et al., U.S. Pat. No. 5,607,162 dated Mar. 4, 1997 a method of playing another relatively complex matching wagering game is provided between players and a dealer whose outcome is determined by randomly generated playing cards. After an ante bet is wagered, the dealer deals five cards to each player and deals seven cards to himself. A round of play is then commenced where the dealer plays a card from his hand to present the rank and suit thereof. Next, each player plays a "matching" card from his respective hand which is either the same suit or the same rank. In this manner, each player reduces the number of cards in his hand where a matching card is played during the round. The conducting of a round of play is then repeated until each card in the hand of the dealer has been played. Seven rounds are thus played each game, so that ultimately there are no cards left in the hand of the dealer. The ante bet of each respective player is consequently paid off as follows: (a) To each player if each player has no card remaining; or (b) to the dealer if each player has one or more cards remaining. Preferably, prior to the round of play, each player determines whether his respective hand has a hand rank in poker exceeding three of a kind. If the player does have such a highly ranked hand, the dealer pays off an amount to that player which is a multiple of the ante bet.

Even Earlier in Moody in U.S. Pat. No. 5,489,101 dated Feb. 6, 1996 yet another relatively complex game was patented. The object of this game is for a player to form a five card poker hand that has the highest poker hand ranking. In the house banked version, all players play against the house and not against each other. The game is played with a standard fifty-two card deck. The game consists of a dealer and from one to seven players. Each player makes a bet and a portion of each bet may be allocated to a progressive jackpot. The dealer deals five cards to each player. The dealer then deals six cards as the community cards which are arranged face down in three rows in a triangle pattern on the gaming table layout. The players may discard from none to five unwanted cards. The dealer turns up the community cards and pre-designated groups of cards from the community cards are used for each player to make a complete five card poker hand. The dealer determines the best hand each player has made according to poker hand rankings. All winning hands will be paid by the dealer according to the odds listed in the pay table. When the progressive jackpot payout is used, the dealer examines the six community cards to determine if one of the predetermined card arrangements has occurred. Any winning payoffs from the progressive jackpot are distributed to the players at the table. The method may also be played as a player banked game or as a pot game.

And, on Jan. 23, 1996 Neal was granted U.S. Pat. No. 5,486,005 for yet another complex novel method and apparatus for playing another poker-like game with a deck of fifty-two playing cards wherein each player plays against the dealer. After each player makes a wager, the dealer deals four initial cards of the deck face up to seven separate hands, places odds on each hand according to predetermined guidelines, and selects two of the seven hands as a combination field position. Each player then selects either one of the hands, the field position, or a no-hand winning position which requires that none of the seven hands, after all cards are dealt, have two pairs or better. After each player selects a hand or a position, the dealer deals three more cards of the deck face up to each of the seven separate hands. The dealer then determines the winning hand or position and pays each player who selected the winning hand or position according to the odds and their wager or collects each player3 s wager who did not select the winning hand or position. Additionally, a jackpot wheel may be included to permit an added possibility of winning a larger payout.

In the midst of the prior decade, U.S. Pat. No. 5,395,120 was granted to Malek in March of 1995 for another relatively complex poker-like card game, in particular, a card game suitable for use in casinos, and for a specifically designed table for playing the game. Specifically, this invention relates to a method of and apparatus for playing a casino game simultaneously against a dealer and against other players. More specifically, this invention relates to a method of and an apparatus for playing a mixture of draw poker and one of twenty-one and baccarat wherein a player can simultaneously play Draw Poker against a dealer and one of Twenty-one and Baccarat against other players.

Virtually all casinos, especially those in the gaming capitals of the world, have board games that are played for gambling purposes. Due to the complexity involved in playing the popular wagering games employing cards such as poker, blackjack, and baccarat, for example, as exemplified by the brief summaries given above, there is a need for a simpler game of chance that will appease all strata of expertise in the art of card gambling, yet remain challenging and enjoyable.

U.S. Design Pat. No. 263,975, issued to John S. Quiroga, et al. on Apr. 20, 1982, discloses an ornamental design for a gaming table. By contrast the instant invention is not directed to any sort of ornamental appearance of a game table although playing considerations dictate certain broad geometric relationships between the various play areas on the table. In addition, the required geometric relationships of the instant invention, the novel game and table, are far removed in appearance and function from the black-jack-type table of Ouiroga, et al.

As evinced above, the game of poker is an extremely popular game currently found in most Las Vegas casinos, the rules of which are widely published and have numerous variations. This game provides numerous betting options, but the game involves complicated increasing or decreasing odds depending on the number of decks of cards used. Winning hands may include two pairs, three of a kind, four of a kind, and straights. The novel game presented here is significantly distinct from poker. This makes the novel game attractive to those who enjoy card games but are uncomfortable with the rules of poker and the like.

3. Objects of the Invention

The complexity of the novel game over the prior art games is substantially diminished or eliminated and the novel method enables the game to move quickly thereby decreasing the associated operational overhead. An advantage of the novel 52 card pot card game invention as with the great advantage with roulette, which leads to its popularity, is its simplicity and accessibility to the ever-increasing numbers of novice gamblers. Therefore, despite the popularity of both craps and roulette, the novel game presents several disadvantages to the casinos and players alike. Although there have been attempts to improve upon existing games and to develop new games of chance, none of the prior art games have been able to overcome the complexity disadvantages described herein. Thus, a need exists for a wagering game employing a standard deck of cards that is intended to be played in gambling casinos, that is simple to learn and play, and that results in more wagering decisions per hour and increased revenues for the casino.

For the foregoing reasons, there is a need for simplicity of betting wherein a winning bet is easily recognized. It would be a benefit, therefore, to have a card game allowing players to compete against the house with virtually even odds based on a variations of high card wins, like cards draw or push, and players' deuces and aces provide an advantage to the player.

The gaming method disclosed is designed to quickly build excitement and anticipation with only two successive turnovers of top cards per game, and as such is intended as a quick paced and an unusually exciting game to play and/or observe. Even more particularly, the instant invention is intended to give a novel and new look and feel to the currently popular card games, yet have simplified rules and procedures designed both to encourage use by novice gamblers and to increase the betting decisions per hour to maximize casino profit.

SUMMARY OF THE INVENTION

The preferred embodiment of the present invention is directed to a novel game and board surface in combination to be played in combination by at least two players, one being a player and bettor and the other being a dealer or croupier using at least one standard deck of 52 cards. Also used by the croupier are a shuffling machine for cards, a dealing machine for cards and a catch bin for discarded or played cards. The order of play and payoffs for each bet are set by the house or the croupier. The novel game is played by a player first placing a bet in a betting spot using chips, for example. Next, the dealer deals six cards to each player face down onto an area on the table called a pot and designated for that player and afterwards deals six cards to another area on the table called a dealer's pot in a location on the table designated for the dealer's pot, One play in a series of six comprises the dealer turning up a player's top card and turning up the dealer's top card: High wins at even odds of 1 to 1; equal cards are a draw or push and neither wins except if a player has a deuce in which case the player3 s deuce loses 1 to 1 odds; a player's ace wins at odds of 3 to 2. After one play, a player may place a new bet before cards are next turned over.

The present card game, while exhibiting many valuable gaming features, as explained below in more detail, also can be inexpensively manufactured and incurs minimal operational overhead expenses. While the present invention may, in one embodiment, comprise a separate, approximately five-foot semi-circular table, the present playing surface may be formed as a thin overlay to be placed atop existing casino game table equipment such as craps tables. In addition, if there are an insufficient number of players to warrant operating a full table, the table may be split in half, with one half of the table unoccupied, and the other half utilized for playing the game. Advantageously, the operational expenses associated with the present game are low. To operate the present game, the casino need only employ one dealer or croupier. Moreover, the game can easily be played with artificial money or chips at home as a family recreation.

The game has a minimal number of rules, and the rules are readily apparent to the novice gambler after very little observation.

In the preferred embodiment of the present game of chance, every wager is effective until each set of two cards, the top one from each player and the top one from a dealer is turned up and compared. A wager on a game is over after only two cards are compared. Therefore, in contrast to the prior art games, such as blackjack, the present game produces more wagering decisions, successes or failures, per hour. This results in more overall revenue for the casino. Thus the present invention represents a substantial improvement over casino games of the prior art because it simplifies play and encourages wagering, which in turn leads to increased entertainment and increased revenue for the casino.

BRIEF DESCRIPTION OF THE DRAWING

These and other features, aspects, and advantages of the present invention will become better understood with regard to the following description, appended claims, and accompanying drawings wherein:

DESCRIPTION OF THE PREFERRED EMBODIMENT

Figure 1:
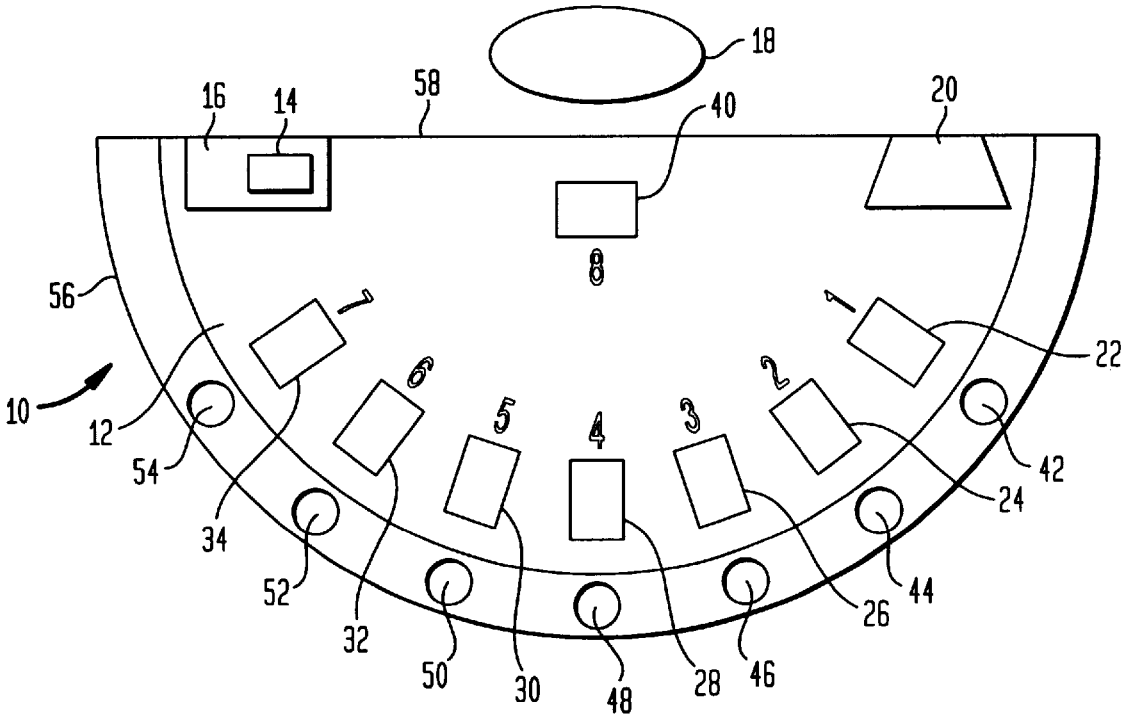
FIG. 1 is a plan view of a first preferred embodiment of the playing surface on which the game of the invention is played.

The present invention will be described hereinafter with reference to the accompanying drawing, specifically FIG. 1, and the rules of the novel game printed herein which illustrate an embodiment and the method of the invention.

The method of the invention incorporates the following rules, to wit:

RULES OF THE NOVEL GAME

1. The improved game is played on a casino-type card table. There are eight spaces for the pots to be placed on the table (see FIG.1). A circular space is located near each pot except to pot designated for the banker, dealer, croupier, or house. A pot is defined herein as a pile of cards initially placed face down. The circular space is adapted to receive bets or wagers via chips or tokens. In the novel game there are a maximum of eight pots inclusive of a pot for the banker or dealer of cards during the play of the novel game. The last pot shall always be assigned to the banker or dealer.

2. To play the game, all initial bets are made before the cards are dealt. All of the dealt cards are dealt face down into the eight pots after the initial bets or wagers are placed in the circular spaces. The cards or pots (piles of cards) are dealt only to those spots where bets have been put down on the table. However, the dealer always receives a pot. The dealer may be either a person or a mechanized card dealer operated by a croupier.

3. Next, the dealer or croupier shall count out six (6) cards for each pot sequentially, first with six cards face down for the first pot, etc. If seven bets have been placed at each of the seven spots then eight piles of six cards each are dealt onto the table for each of the seven pots plus one for the dealer or banker. The only pots are those dealt to players. The pots are located in front of players who have placed wagers.

4. After the wagers are placed on the table by the players (the game is limited to up to seven players and one dealer or banker) and the pots are in place on the table, the dealer turns over the top card from each pot or pile of cards. In the novel game, all deuces are nullities and players with deuces lose the respective round.

5. The dealer or banker pot card at the top is turned up last. All pot cards are turned up from the dealer's left to the dealer's right. If a dealer's card matches a player's upturned card these rules designate this event as a push or draw and neither the player nor the dealer wins or loses except if the player's upturned card is either an ace or a deuce and the dealer's upturned card is also an ace or a deuce, respectively, the players ace wins his wager at odds of 3 to 2; the players deuce loses. Otherwise, when a players upturned card matches a dealer's upturned card the player wins at even odds of 1 to 1.

6. The dealer or house shall be able to set limits on wagers at all times during the game and before a play. A play is defined as the act of up turning the top card of each pot. After a play resulting in win or a lost a new wager can be placed by the player.

7. The cards shall only be handled and touched by the dealer. At the option of the dealer or house, if a player touches a pot, that pot may be discarded.

8. After a dealer announces "no more bets", new bets cannot be added to the table or removed from the table. The dealer shall announce and declare that wagering is closed before the first pot is dealt and for each player before a next card is upturned for a player.

9. At the option of the dealer, a plurality of card decks may be used to play the game.

Note: These rules define a game that is virtually a head to head play against the dealer or house with almost even odds. The house or dealer can change and/or set the minimum and maximum wagering limits at any time during play.

The novel method specified by the above rules is best described by referring again to FIG. 1. There is shown a top of a table 10 with a specific and preferred layout on the surface 12. In the novel method a combination card deck 14 and shuffling machine 16 is used to deal cards from the card deck 14 onto the surface 12 by a dealer or croupier 18. A receptacle means 20 or space is designated on the table 10 for receiving cards discarded during play of the game.

Shown in FIG. 1 are seven playing areas or pots 22, 24,26, 28, 30, 32, and 34. Also shown is an eighth pot 40, designated a "dealer's pot". In front of each of the pots 22, 24,26, 28, 30, 32, and 34 are betting spots 42, 44, 46, 48, 50, 52, and 54, respectively, where players (not shown) located about an edge 56 of the table 10 make put down bets made either with money or chips, for example.

The seven playing areas or pots 22, 24,26, 28, 30, 32, and 34 are visibly and distinguishably marked with a designation such as a different numeral proximate to each of same, i.e., Arabic numbers 1,2,3,4,5,6, and 7 as shown in FIG. 1. The dealer3 s pot 40 is similarly distinguished and marked with an Arabic numeral 8 proximate thereto, for example.

The novel method is enabled by providing a planar game playing surface, the surface 12 marked as shown in FIG. 1, for example. The surface 12 has a plurality of areas designated for bets. There is shown at least seven separately delineated areas adapted for the placement of bets, namely, betting spots 42, 44, 46, 48, 50, 52, and 54.

A first area of the table 10, as shown in FIG. 1, has the seven betting spots 42, 44, 46, 48, 50, 52, and 54 arrayed in a semi-circle. A second area is shown with seven rectangular polygonal areas or playing areas or pots 22, 24,26, 28, 30, 32, and 34 arrayed thereon, each with a betting spot nearby.

A third area wherein the dealer's pot 40, rectangular in configuration, for example, is shown near a straight edge 58 of the table 10.

Any odds may be assigned or established by the house for payout of winning bets placed in any of the aforesaid seven separately delineated areas, playing areas or pots 22, 24,26, 28, 30, 32, and 34, for example. Payout ratios may be from 2 to 1 for the most likely to win a bet in integer increments up to 10 to 1, for example, for the least likely to win a bet and depend upon the number of decks used, for example. The house may establish an initial order of play including which players are designated as first player, second player, and so on to a last player.

The game described herein is capable of play at a casino, on the Internet, on cruise ships, and it is contemplated that it may also be adapted for slot machine play by one of ordinary skill in this art. It is to be understood that the present invention is not limited to the embodiments described herein, but in accordance with the doctrine of equivalents, including equivalents as to functions as combined with appearance, encompasses any and all embodiments within the scope of the following claims, to wit:

What is claimed is:

1. A method for playing a wagering card game comprising the steps of:

Providing a shuffled stack of playing cards where the cards are touched only by the dealer during the game comprising at least one deck thereof; providing a planar game playing surface comprising a plurality of separately delineated areas adapted for the placement of bets; establishing odds for payout of winning bets placed in any of the aforesaid plurality of separated and delineated areas; establishing an initial order of play where players are designated as first player, and so on to a last player; initiating a round of play by a first player establishing a bet by placing a wager in a designated space on the table near a pot designated and marked onto a surface for displaying a face-up side of a card dealt to each said player; dealing a stack of six face-down cards as a player's pot concealing the faces of each dealt card from each player and a dealer, to the first player and any other player in the game; dealing a stack of six face-down cards, concealing the faces of each dealt card from each player and the dealer, to the dealer as a dealer's pot; then, only the dealer turning the dealer's pot over and turning over the pots over for each player one at a time; then the dealer immediately determining a player's winning status or loss status by comparing a face-up card dealt to each player and a now face-up card dealt to the dealer in the dealer's pot; after comparing a dealer's face-up card to a player's face-up card, paying any winning bets placed by each player in the game; collecting the played or turned up cards from each pot after bets are paid and placing these cards in a discarded cards designated area on the table; determining whether the turned-up dealer's card matches the corresponding turned-up player's card, whereby at any time during the game or before the dealer may imposed step of disqualifying and discarding any got touched by a player.

2. The method for playing a wagering card game of chance according to claim 1 further comprising using at least one deck of shuffled, unviewed, face-down cards and also using a substantially flat playing surface having a forward edge and a rearward edge and adapted for playing a game of cards using a deck of cards, the surface further comprising: (a) a primary array of betting spots arranged near the forward edge of the playing surface; (b) a secondary array of spaced apart spaces for placing stacks of dealt cards located on said playing surface between the primary array and the rearward edge, the secondary arraying comprising at least two polygonal areas, one for a player's card pot and another for a dealer's card pot, each area having nearby a different identify symbol displayed nearby and on the playing surface; (c) a machine for shuffling and dealing a deck of cards located on the playing surface; and, (d) a receptacle for discarded cards located on the playing surface.

3. The method for playing a wagering card game of chance according to claim 2 further comprising providing the forward edge of the playing surface as a semi-circular edge and the primary array of betting spots being arranged substantially in a semi-circular pattern near the semi-circular edge of the playing surface.

4. The method for playing a wagering card game of chance according to claim 3 further comprising the step of arranging the secondary array of spaces for placing stacks of dealt cards substantially in a semi-circular pattern on the playing surface between the betting spots and the rearward edge of the playing surface.

5. The method for playing a wagering card game of chance according to claim 1 further comprising using game apparatus in combination with a deck of playing cards and the additional step of allowing one or more persons to participate as players wherein one person acts as a dealer, and further comprising the step of using the game apparatus wherein said apparatus further comprises:

a playing surface having a forward periphery and a rear periphery;

a portion of the surface adjacent the forward periphery thereof having thereon a plurality of player betting areas at spaced apart locations where each player is to be stationed during a game;

means associated with the playing surface at each of said plurality of player betting areas for designating a player's stack of dealt cards;

a portion of the surface adjacent the rearward periphery thereof having thereon a single area and means associated with the playing surface located in front of the dealer for designating a dealer's stack of dealt cards;

means for storing cards associated with the playing surface for identifying a specific location for discarded or played cards; and a machine means for shuffling and dealing cards associated with the playing surface for identifying a specific location for said machine means.

* * * * *